US006480571B1

(12) United States Patent
Andrews

(10) Patent No.: US 6,480,571 B1
(45) Date of Patent: Nov. 12, 2002

(54) DRIVE ASSEMBLY FOR AN X-RAY TUBE HAVING A ROTATING ANODE

(75) Inventor: Gregory C. Andrews, Sandy, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 24 days.

(21) Appl. No.: 09/597,034

(22) Filed: Jun. 20, 2000

(51) Int. Cl.[7] ..... H01J 35/10
(52) U.S. Cl. ..... 378/131; 378/132
(58) Field of Search ..... 378/119, 121, 378/125, 127, 128, 131, 132, 143, 144

(56) References Cited

U.S. PATENT DOCUMENTS

| | | | | |
|---|---|---|---|---|
| 3,720,853 A | | 3/1973 | Atlee et al. | 313/60 |
| 3,855,492 A | | 12/1974 | Langer et al. | 313/60 |
| 4,141,606 A | | 2/1979 | Yamamura | 308/140 |
| 4,272,696 A | | 6/1981 | Stroble et al. | 313/60 |
| 4,670,895 A | | 6/1987 | Penato et al. | 378/125 |
| 4,949,368 A | | 8/1990 | Kubo | 378/132 |
| 4,969,172 A | * | 11/1990 | Fengler et al. | 378/125 |
| 5,303,280 A | | 4/1994 | Crawford et al. | 378/132 |
| 5,308,172 A | | 5/1994 | Upadhya et al. | 384/453 |
| 5,357,552 A | | 10/1994 | Kutschera | 378/132 |
| 5,425,067 A | | 6/1995 | Sano et al. | 378/125 |
| 5,498,186 A | | 3/1996 | Benz et al. | 445/28 |
| 5,588,035 A | | 12/1996 | Chistean et al. | 378/132 |
| 5,655,000 A | | 8/1997 | Benz et al. | 378/144 |
| 5,699,401 A | | 12/1997 | Jackson et al. | 378/144 |
| 5,838,763 A | | 11/1998 | Hiller et al. | 378/133 |
| 6,011,829 A | | 1/2000 | Panasik | 378/130 |
| 6,041,100 A | | 3/2000 | Miller et al. | 378/141 |
| 6,173,996 B1 | * | 1/2001 | Derakhshan et al. | 285/114 |

FOREIGN PATENT DOCUMENTS

| | | |
|---|---|---|
| EP | 0438775 A | 7/1991 |
| JP | 55150540 A | 11/1980 |

* cited by examiner

*Primary Examiner*—David P. Porta
(74) *Attorney, Agent, or Firm*—Workman, Nydegger & Seeley

(57) ABSTRACT

An anode drive assembly for use in an x-ray tube having a rotating anode is disclosed. The anode drive assembly is comprised of a bearing assembly that provides rotational support to a rotor assembly. The rotor assembly is connected to the rotating anode, and rotation is induced in the rotor by way of an inductive motor. The bearing assembly is interconnected with the rotor assembly via a bearing hub. The bearing hub is comprised of a material having a coefficient of thermal expansion (CTE) that is intermediate to that of the components connected directly to the anode, and to the bearing shaft component. This provides a gradual transition in CTE along the conductive path between the anode and the bearing shaft so as to reduce the occurrence of thermal expansion rate disparities between adjacent components.

42 Claims, 3 Drawing Sheets

DRIVE ASSEMBLY FOR AN X-RAY TUBE HAVING A ROTATING ANODE

BACKGROUND OF THE INVENTION

1. The Field of the Invention

The present invention relates generally to x-ray tubes that use a rotating anode target. More particularly, embodiments of the present invention relate to an improved rotating anode drive assembly, and methods for manufacturing an anode drive assembly, that provide improved mechanical stability in the presence of high operating temperatures.

2. The Relevant Technology

X-ray producing devices are extremely valuable tools that are used in a wide variety of applications, both industrial and medical. For example, such equipment is commonly used in areas such as diagnostic and therapeutic radiology; semiconductor manufacture and fabrication; and materials testing.

The basic premise underlying the production of x-rays in such equipment is very similar. X-rays, or x-radiation, are produced when electrons are released and accelerated, and then stopped abruptly. Typically, the process takes place within an evacuated x-ray tube, which ordinarily includes three primary elements: a cathode, which is the source of electrons; an anode, which is axially spaced apart from the cathode and oriented so as to receive electrons emitted by the cathode; and an electrical circuit for applying a high voltage between the cathode and the anode.

The anode and cathode elements are positioned within the evacuated housing, and then electrically connected. During operation, an electrical current is supplied to the cathode filament, which causes electrons to be emitted. A voltage generation element is then used to apply a very high voltage (ranging from about ten thousand to in excess of hundreds of thousands of volts) between the anode (positive) and the cathode (negative). The high voltage differential causes the emitted electrons to accelerate towards an x-ray "target" surface positioned on the anode. Preferably, the electron beam is focused at the cathode so that the electrons strike the target surface (sometimes referred to as the focal track) at a defined point, referred to as the "focal spot." This target surface is comprised of a refractory metal having a relatively high atomic number so that when the electrons collide with the target surface at the focal spot, a portion of the resulting kinetic energy is converted to electromagnetic waves of very high frequency, i.e., x-rays. The resulting x-rays emanate from the target surface, and are then collimated for penetration into an object, such as an area of a patient's body, and then used to produce an x-ray image. In many applications, such as a CT system, precise control over the size and shape of the focal spot is critical for ensuring a satisfactory x-ray image.

In general, a very small part of the electrical energy used for accelerating the electrons is converted into x-rays. The remainder of the energy is dissipated as heat in the anode target region and the rest of the anode. This heat can reach extremely high temperatures that can permanently damage the anode structure, and/or can reduce the operating efficiency of the tube. To alleviate this problem, the x-ray target, or focal track, is typically positioned on an annular portion of a rotatable anode disk. Typically, the anode disk (also referred to as the rotary target or the rotary anode) is mounted to a rotor assembly having a supporting shaft that is rotatably supported by bearings contained within a bearing housing. The rotor assembly and disk are then appropriately connected to and rotated by a motor. During operation, the anode is rotated and the focal track is rotated into and out of the path of the impinging electron beam. In this way, the electrons are striking the target at specific focal spots for only short periods of time, thereby allowing the remaining portion of the track to cool during the time that it takes to rotate back into the path of the electron beam. This reduces the amount of heat generated at the target in specific regions, and reduces the occurrence of heat related problems in the anode target.

The rotating anode x-ray tube of this sort is used in a variety of applications, some of which require the anode disk to be rotating at increasingly high speeds. For instance, x-ray tubes used in mammography equipment have typically been operated with anode rotation speeds around 3500 revolutions per minute (rpm). However, the demands of the industry have changed and high-speed machines for CT Scanners and other applications are now being produced that operate at anode rotation speeds of around 10,000 rpm and higher. These higher speeds are necessary to evenly distribute the heat produced by electron beams of ever-increasing power.

The higher operational rotating anode speeds, and the higher heat loads typical of the newer x-ray tubes, contribute to a variety of problems. For instance, much higher stresses are placed on the bearings, and the other portions of the anode drive assembly, due to the forces exerted as a result of the high rotational speeds. These mechanical stresses are exacerbated in the presence of the high operating temperatures of an x-ray tube. Existing drive assemblies have not been entirely satisfactory in dealing with these extreme operating conditions. For example, a typical prior art anode drive assembly is constructed with multiple components having different material types, and which are interconnected with numerous braze and/or weld joints. This use of multiple components, and multiple connection points, are subject to failure, and can be a source of mechanical instability. For example, excessive heat can cause the physical connections in the anode rotor structure and bearing assembly to loosen, especially when the component parts and/or the braze joints are constructed of different metals that have dissimilar coefficients of thermal expansion (CTE). Points of mechanical instability can also arise where interconnected parts have improper mating surfaces, are improperly assembled, and/or have insufficient fastener preloads. Again, each of these problems are further exacerbated in the presence of the extremely high thermal stresses encountered within the rotor assembly. Any one of these problems can contribute to the instability of the rotor assembly, which results in a non-stable rotation of the anode target. This is manifested in unpredictable movement and positioning of the focal spot on the target, which degrades the resulting x-ray image quality.

In addition to diminishing the quality of the x-ray image, any mechanical instability in the anode drive assembly can result in other problems as well. For instance, it can result in increased noise and vibration, which can be unsettling to a patient and distracting to the x-ray machine operator. Also, unchecked vibration can shorten the operating life of the x-ray tube.

In light of the foregoing problems, what is needed is an improved anode drive assembly that can be used to support and rotate a target anode in a x-ray tube. In particular, the drive assembly should permit the anode to be rotated at very high speeds without vibrating or generating noise. Moreover, the drive assembly should maintain this mechanical stability, even in the presence of high operating temperatures.

OBJECTS AND BRIEF SUMMARY

The present invention has been developed in response to the present state of the art, and in particular, in response to these and other problems and needs that have not been fully or completely solved by currently-available drive assemblies for use in connection with x-ray tubes having rotating anodes. Thus, it is an overall object of the present invention to provide an anode drive assembly that is capable of rotating an anode target at high rotational speeds, and that can do so with minimal vibration and noise. A related object of the invention is to provide an anode drive assembly that maintains mechanical stability even in the presence of high operating temperatures. Further, it is an objective to provide an anode drive assembly that reduces the amount of heat that is conducted from the anode target to more heat sensitive portions of the bearing assembly, such as bearings and bearing surfaces. Another objective is to provide an anode drive assembly that utilizes fewer components and fewer attachment points, thereby reducing the opportunity for mechanical failure due to disparate thermal expansions between components, joint failure, improper component fit, improper assembly, and the like. Also, it is an objective to provide an anode drive assembly that is assembled in a manner so that there is a gradual transition in the coefficient of thermal expansion along the thermal conductive path between the anode and the bearing assembly. This ensures that adjacent components have closely matched coefficients of thermal expansion, thereby reducing mechanical stresses that may result in the presence of high operating temperatures.

In summary, the foregoing and other objects, advantages and features are achieved with an improved rotating anode drive assembly for use in connection with an x-ray tube having a rotating target anode. Embodiments of the present invention are particularly suitable for use in connection with x-ray tubes used in equipment requiring high anode rotational speeds, and in which precise control over the focal spot position is required—such as CT scanner x-ray tubes.

In a preferred embodiment, the anode drive assembly is comprised of a target rotor assembly, which is connected to the anode disk via a shaft portion. The target rotor is rotatably supported by a bearing assembly having a bearing shaft that is rotationally supported via a bearing surface. The target rotor preferably provides an inductive motor capability, such that rotating motion can be provided to the anode via the target rotor.

In a preferred embodiment, the bearing assembly is operatively connected to the rotor assembly via a bearing hub. The bearing hub preferably includes means for reducing the amount of heat that is transferred from the anode to the bearing shaft and other portions of the bearing assembly. In one embodiment, this is accomplished by minimizing the conductive heat path between the anode to the rest of the bearing assembly via the structure of the bearing hub.

Preferred embodiments improve the mechanical and thermal attributes of the anode assembly in other ways as well. Preferably, the anode assembly is constructed of materials such that there is an incremental increase in the coefficient of thermal expansion between the target anode and the bearing surfaces of the bearing assembly. This gradual transition in thermal expansion rates reduces the amount of thermal and mechanical stresses that occur along the assembly during operation of the x-ray tube. Moreover, the bearing assembly is preferably constructed so that components immediately adjacent to the anode—namely the rotor shaft—experience substantially the same rate of thermal expansion as the anode itself. These factors all contribute to the overall mechanical stability of the drive assembly, and ensure precise rotation of the anode, accurate and consistent placement of the focal spot, and increased x-ray image resolution. Further, the increase in mechanical stability results in an x-ray tube having less operational vibration, and consequently, that produces less operating noise. Also, lower vibration reduces the incidence of x-ray tube failure.

These and other objects, features and advantages of the present invention will become more fully apparent from the following description and appended claims, or may be learned by the practice of the invention as set forth hereinafter.

BRIEF DESCRIPTION OF THE DRAWINGS

In order to more fully understand the manner in which the above-recited and other advantages and objects of the invention are obtained, a more particular description of the invention will be rendered by reference to specific embodiments thereof which are illustrated in the appended drawings. Understanding that these drawings depict only typical embodiments of the invention and are not therefore to be considered to be limiting of its scope, the invention in its presently understood best mode for making and using the same will be described and explained with additional specificity and detail through the use of the accompanying drawings in which.

DETAILED DESCRIPTION OF THE PREFERRED EMBODIMENTS

Reference will now be made to figures wherein like structures will be provided with like reference designations. It is to be understood that the drawings are diagrammatic and schematic representations of presently preferred embodiments of the invention, and are not limiting of the present invention nor are they necessarily drawn to scale.

Figure 1:
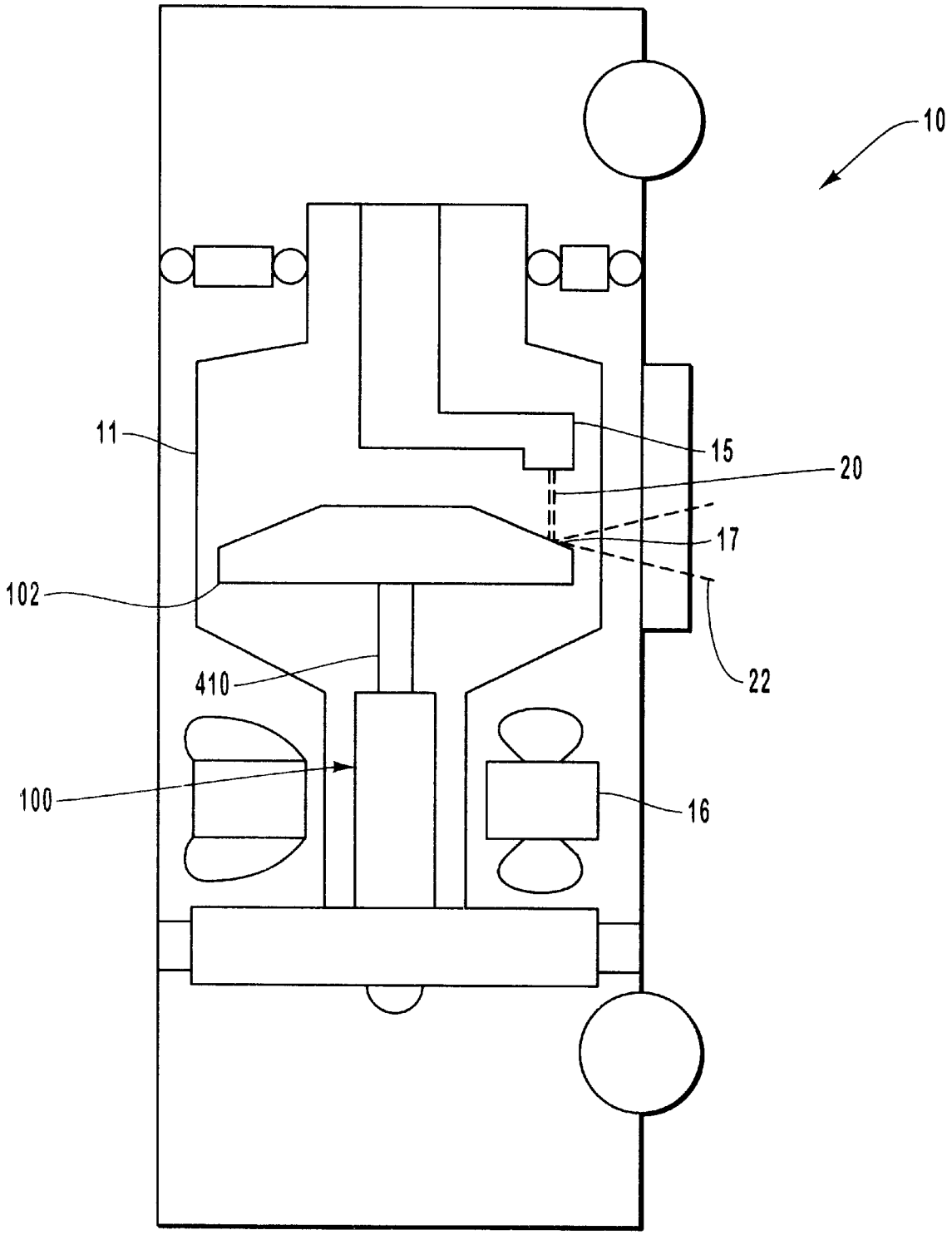
FIG. 1 is a simplified side view cross-section of a conventional x-ray tube showing the primary components of an x-ray tube, including a drive assembly for the rotating anode.
Figure 2:
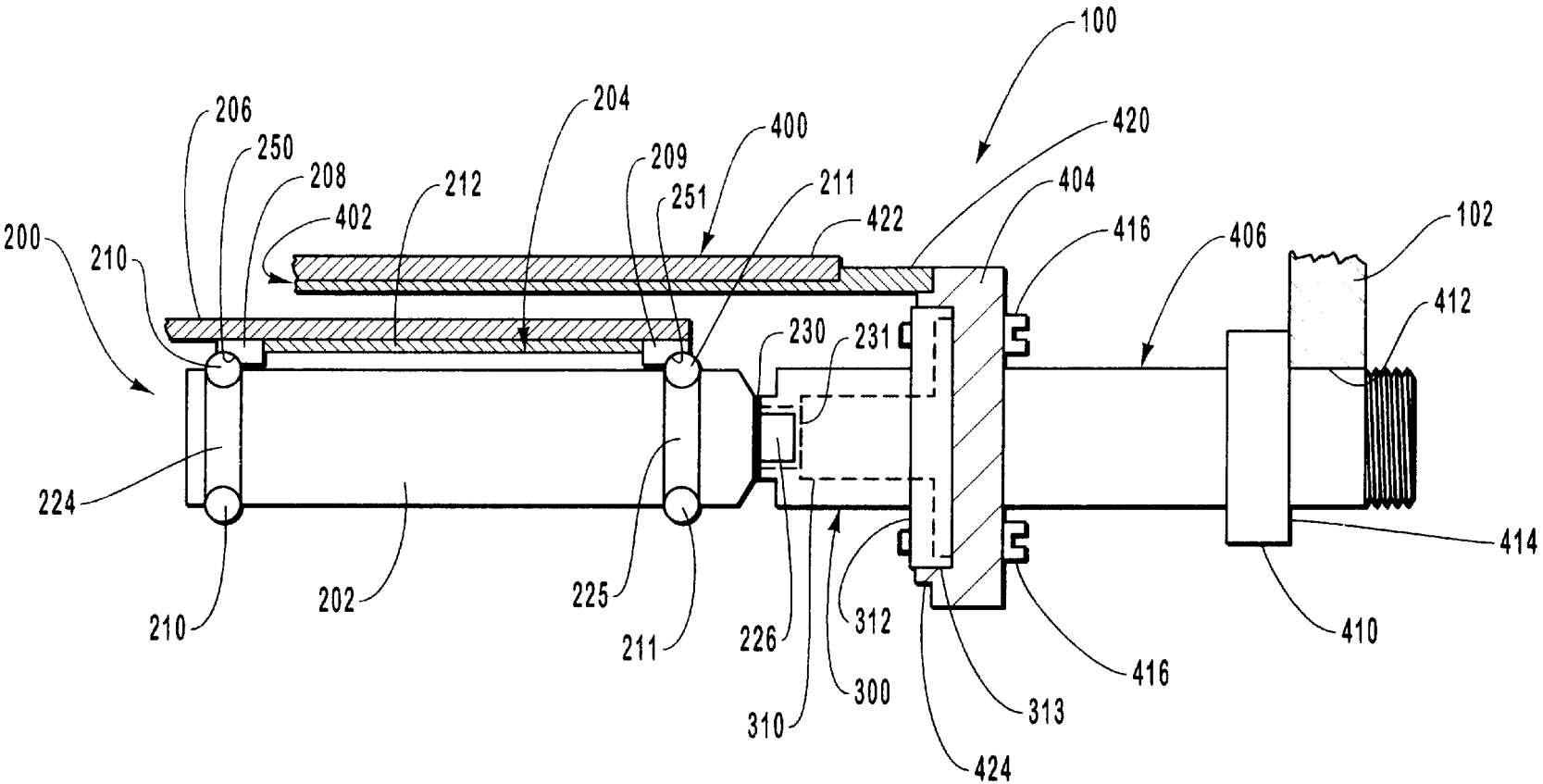
FIG. 2 is a side, partial cross-section view of one presently preferred embodiment of an anode drive assembly that could be used in an x-ray tube of the sort illustrated in FIG. 1.
Figure 3:
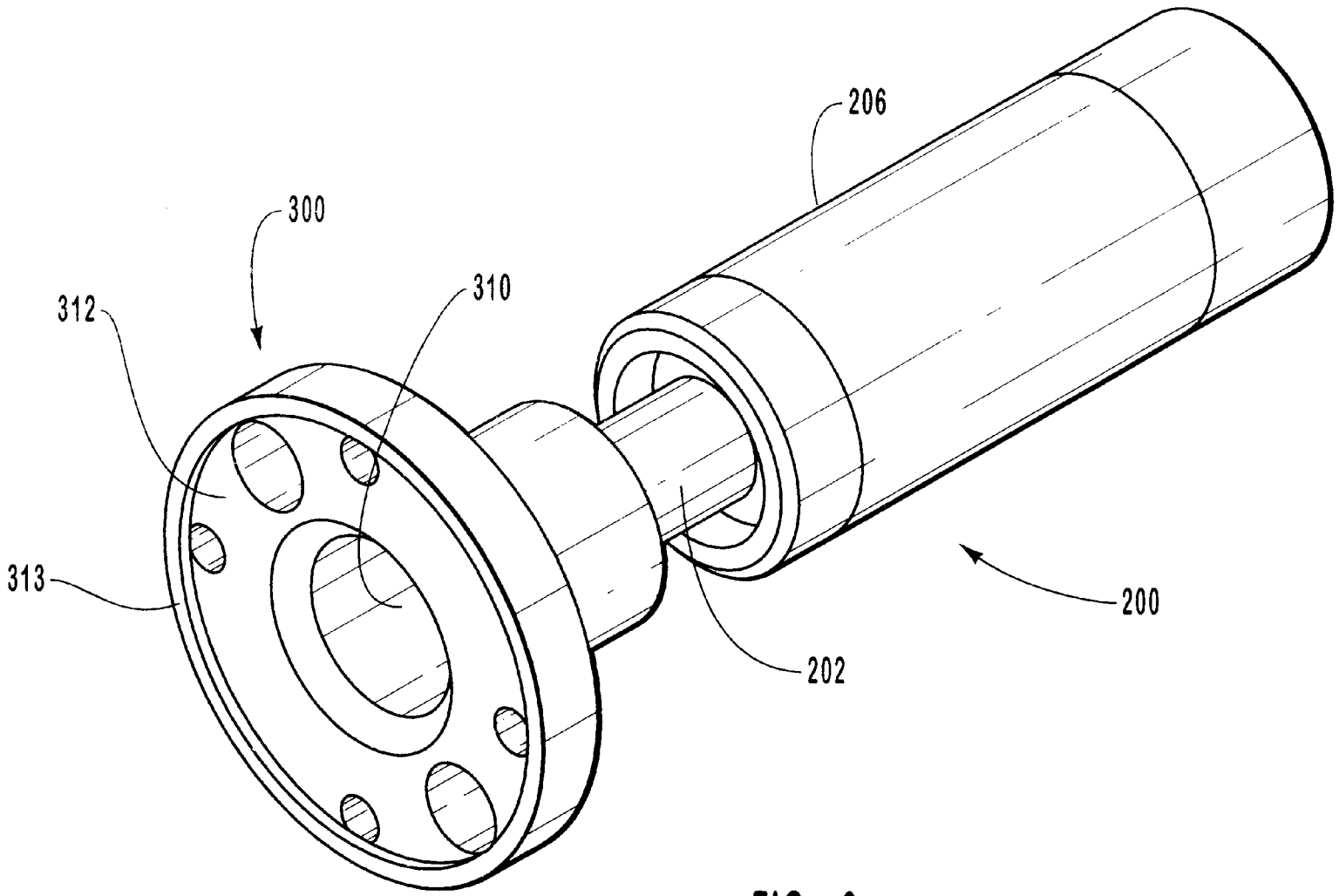
FIG. 3 is a perspective view showing one presently preferred embodiment of a bearing assembly used in the anode drive assembly.

In general, the present invention relates to embodiments of an anode drive assembly that can be used in connection with an x-ray tube having a rotating target anode. In preferred embodiments, the anode drive assembly is particularly useful in x-ray tube equipment that require high anode rotational speeds and that experience high operational temperatures. For example, embodiments of the present invention will find particular use in CT scanner x-ray tubes having heat storage capabilities between about 0.7 MHU and 2.0 MHU However, it will be appreciated that the teachings of the present invention are applicable to other x-ray tube applications. FIG. 1 illustrates one exemplary x-ray tube environment that can be used in connection with embodiments of the present invention, and FIGS. 2 and 3 show an example of a presently preferred anode drive assembly constructed in accordance with the teachings of the invention.

Referring first to FIG. 1, an example of a simplified rotating anode type x-ray tube illustrated and is designated generally at 10. The x-ray tube 10 includes a tube insert 11 in which is disposed an anode assembly having an anode target 102 that is connected to a rotating shaft 410. An anode drive assembly, designated generally at 100, which will be described in further detail below, serves to facilitate the rotation of the anode target 102. Further illustrated is the manner in which the anode target 102 is spaced apart from the cathode assembly 15. As is well known, the cathode 15 structure includes a cathode head and a filament (not shown), which is connected to an appropriate power source. The cathode and anode are located within a vacuum envelope bounded by the x-ray insert 11. Also, in the embodiment illustrated, a stator assembly 16 is placed around the neck portion of the vacuum envelope of the x-ray insert 11. When the stator 16 generates a rotating magnetic field, the rotor portion of the anode drive assembly 100 (described in further detail below), which opposes the stator 16 through the wall of the vacuum envelope, rotates at a predetermined high speed thereby causing rotation of the anode target 102.

As is well known, an electron beam (represented by dotted lines at 20) is generated by placing high voltage between the cathode 15 and the rotating anode target 102 and then heating the cathode filament (not shown) with an electrical current. This causes the electrons emitted from the filament to accelerate towards, and then strike, the target surface of the rotating anode target. Ideally, a majority of the electrons strike the target surface at a precise location referred to and designated as the focal spot 17. A portion of the resulting kinetic energy from the electron collisions results in the generation of x-rays; a majority of the kinetic energy is dissipated as heat. The x-rays are then emitted from the surface of the rotating anode target as is represented by the dotted lines at 22 in FIG. 1. The x-ray signals can then be used to produce, for instance, medical images.

The quality of the image obtained by processing the data from the x-ray tube, and as a result, the diagnostic capability of the x-ray tube, depends on a variety of factors. For instance, high image quality requires that the impinging electron beam strike the anode target within the specific focal spot region 17. If electrons deviate from this focal spot region, the characteristics of the resulting x-rays will be altered, resulting in lower image quality. As previously noted, if the rotating anode target 12 vibrates, or does not maintain a precise rotational path, the electron beam will impinge the target surface at positions that vary from the desired focal spot region, and decrease the resulting image quality. Such mechanical instability and resultant vibration can result from a variety of factors, including misalignment of parts in the drive assembly, disparate thermal expansion rates in the different component materials and braze joints, high operating temperatures, and high rotational speeds. In addition to affecting image quality, vibration of the x-ray tube components can also cause acoustic noise to be emitted from the x-ray tube and the x-ray device. This acoustic noise can be disturbing to the patient undergoing treatment with the device, as well as to operators of the device. Further, vibration can ultimately lead to failure of tube components.

Reference is next made to FIG. 2, which is a side elevational and partial cross-sectional view showing one presently preferred embodiment of an anode drive assembly 100 that can be used in an x-ray tube, such as that illustrated in FIG. 1. In particular, the anode illustrated drive assembly addresses the aforementioned mechanical and thermal stability problems to maintain x-ray image quality. In general, the illustrated anode drive assembly 100 is comprised of a bearing assembly, designated generally at 200, that is adapted to rotationally support a target rotor assembly, which is designated generally at 400. The target rotor assembly is operatively connected to the target anode disk 102, thereby allowing rotational motion to be imparted to the anode disk. Presently preferred embodiments of these various components are described in further detail below.

FIG. 2 shows how a presently preferred embodiment of the bearing assembly 200 includes an elongated cylindrical bearing shaft 202, and a means for rotationally supporting the shaft 202. By way of example, and not limitation, the rotational support means is comprised of a stationary cylindrical housing 206, which forms an axial cavity. Disposed within the cavity is a bearing stack, designated generally at 204, that radially and axially supports the bearing shaft 202 in a manner so as to provide free rotation of the shaft within the stationary housing 206. In a preferred embodiment, the bearing stack 204 includes bearing surfaces provided by way of bearing rings 208 and 209, which engage corresponding rolling contact elements such as bearings 210 and 211 respectfully. It will be appreciated that additional bearing rings could also be used, or that rotational support of the shaft 200 could be provided with other structures. As is further shown, the shaft 202 is preferably formed with two circumferential grooves 224 and 225, which serve as the inner races for the bearings 210 and 211. The bearing rings 208, 209 are radially mounted about the shaft 202 at two opposing ends, and are of such inside diameter as to receive the shaft 202. When assembled, the shaft 202 is rotatably supported by the bearings 210 and 211, which are in turn constrained by the corresponding bearing rings 208, 209.

In the illustrated embodiment, the bearing rings 208, 209 are counter-bored so as to form shoulders, shown at 250, 251, that are formed with a radius adapted to accommodate the bearings 210, 211. These shoulders 250, 251 each function as an outer race for the corresponding bearings 210, 211, and also maintain and assure the radial and axial alignment of the bearings and the shaft. In a preferred embodiment, each bearing ring 208, 209 contains any appropriate number of rolling contact elements such as ball bearings. In preferred embodiments, a smaller number of bearings may be used (such as 8), in each bearing ring 208, 209 to minimize both the frequency with which the rolling contact bearings collide with each other and, accordingly, the noise and vibration associated with the collisions. Disposed between the rings 208 and 209 is a spacer 212, or similar type of arrangement, which provides an appropriate axial separation between the bearing rings 208 and 209.

In one presently preferred embodiment, the inner bearing shaft 202 is constructed of a material known by the tradename CPM Rex 20, also known as M62 steel. The coefficient of thermal expansion for this particular material is approximately $12.4\times10^{-6}$ in/in ° C. over the temperature range of 38–538° C. It will be appreciated that other materials that exhibit similar thermal and mechanical strength characteristics could also be used.

In one preferred embodiment, the bearing assembly also includes means for interconnecting the bearing assembly with the target rotor assembly. By way of example, this function is provided by a bearing hub, which is designated generally at 300 in FIGS. 2 and 3. The bearing hub 300 is operatively connected to the bearing shaft 202 so that it rotates with the shaft. In addition to interconnecting the target rotor assembly 400 with the bearing assembly 200, in a presently preferred embodiment, the bearing hub 300 provides two additional functions: (1) it provides thermal resistance between the rest of the bearing assembly (i.e., the bearings and bearing surfaces); and (2) it ensures that there is a gradual transition in the coefficient of thermal expansion between the target anode 102 and the bearing shaft 202. This functionality provides a number of advantages. In particular, by providing increased thermal resistance, less heat is conducted to the bearing stack, thereby reducing the occurrence of problems that can contribute to noise and mechanical instability, such as thermal expansion and premature bearing failure. Further, the transition in thermal expansion coefficient further insures mechanical stability by reducing the incidence of mechanical failures that can occur with adjacent components having severe differences in thermal expansion rates.

While other physical geometries could be used, a preferred bearing hub 300 is cylindrical in shape, and has formed therein a bore, designated at the dotted lines 310, and also shown in the perspective view of FIG. 3. The bore 310 is sized and shaped with a diameter (or other suitable configuration) that mates with and receives a correspondingly shaped end 226 of shaft 202 in a tight fitting manner. In a preferred embodiment, the connection is then secured by way of welded joints, or with a suitable brazing alloy. If welded, the preferred weld joint consists of two welds, one formed on each side of the interface between the shaft 202 and the hub 300, as is indicated at 230 and 231.

The preferred bearing hub 300 further includes a cylindrical flange portion 312, best shown in FIG. 3, that is formed about the periphery of one end of the hub and that is configured to facilitate connection of the hub 300 (and the rotating shaft 202) to the target rotor assembly 400. In a preferred embodiment, the hub includes means for reducing the transfer of heat from the anode target to the bearing shaft. In a preferred embodiment, this function is provided with structure that reduces the heat conduction path between the anode and the bearing shaft 202, preferably comprising a ridge 313 formed about the periphery of the flange 312. The ridge 313 defines an inner bore having a diameter that is larger than the bore 310. The flange 312 and ridge 313 minimize the heat conduction path to the bearing stack, thereby providing a level of thermal resistance between the rotating anode 102 and the bearing stack 204 and bearings 210, 211.

In addition, preferred embodiments utilize a bearing hub 300 that is constructed of a material that provides a thermal expansion rate that falls somewhere between that of the rotor stem 406 material and the bearing shaft 202 material, thereby minimizing disparate thermal expansion rates between adjacent components. This is accomplished by providing a bearing hub 300 that is comprised of a material commonly referred to as a "super alloy" that exhibits a combination of strength at elevated temperatures, and a thermal expansion between approximately $8.0\times10^{-6}$ in/in ° C. and $10.0\times10^{-6}$ in/in ° C. Examples of presently preferred materials include Incoloy 909, CTX 1, and Thermo-Span. In particular, the coefficient of thermal expansion of the hub 300 is chosen to be between that of the components connected to the rotating anode, e.g., the rotor stem 406 (described below), and that of the components in the rest of the bearing assembly, e.g., the bearing shaft 202. This provides a gradual transition in the coefficients of thermal expansion along the thermal conductive path between the anode 102 and the bearing assembly 200. In this way, the hub material expands at a rate that is intermediate to the expansion rates of the surrounding materials, thereby reducing the mechanical and thermal stresses presented by the high operating temperatures.

In addition, such preferred materials for the hub exhibit relatively low thermal conductivities. This further facilitates the thermal resistance of the hub, and minimizes the amount of heat that reaches the bearing assembly. Typical thermal conductivity for the preferred materials is between approximately 10 to 25 W/(m-K), depending on the exact material used and the material's temperature.

With continued reference to FIG. 2, a presently preferred embodiment of the target rotor assembly 400 will now be described. In general, the assembly 400 is comprised of a cylindrical magnetic flux sleeve, designated generally at 402, a rotor cover 404, and a rotor stem, designated generally at 406.

As is shown, the rotor cover 404 connects to the rotor hub 300 so as to operatively interconnect the target rotor assembly 400 with the bearing assembly 200. In the preferred embodiment, the rotor cover 404 is affixed directly to the bearing hub 300 at the cylindrical flange 312 using a suitable attachment means, which in the illustrated embodiment is a plurality of fasteners such as four screws 416 (two of which are shown in FIG. 2). Other attachment schemes could also be used. In one preferred embodiment, the fasteners used are constructed of the same material used in the rotor stem 406 and the cover 404, so as to match the coefficient of thermal expansion of those components. Alternatively, the material used for the fasteners could be the same as that of the bearing hub 300.

The rotor cover 404 is in turn connected to the cylindrical sleeve 402 and to the rotor stem 406. As such, the entire target rotor assembly is rotationally supported by the bearing assembly 200. The magnetic flux sleeve 402 functions as the rotor portion of an induction motor, thereby allowing rotational motion to be imparted to the rotor assembly 400, in a manner that is well known. In one preferred embodiment, the flux sleeve 402 is comprised of a magnetic sleeve portion 420, such as steel or iron, or an alloy thereof, and is positioned so as to be proximate to the bearing hub 300 and in a manner so that it extends the length of the "motor" section of the rotor. The flux sleeve 402 is further comprised of a second sleeve 422, that is affixed to a portion of the outer periphery of the magnetic sleeve 420. In the illustrated embodiment, the second sleeve 422 is comprised of 101 OFHC copper, and is bonded directly to the magnetic sleeve 420. Other materials could also be used. The use of the magnetic sleeve portion 420 (such as iron) increases the torque produced by the rotor assembly 400, especially during 180 hertz operation and when the operating environment is extremely hot. While a variety of attachment techniques could be used, the second sleeve 422 is bonded to the magnetic sleeve 420 by diffusion bond or braze. In a preferred embodiment, the bond or braze is created by placing the magnetic sleeve 420 inside of the second sleeve 422. Both sleeves are then placed into a graphite fixture for brazing. Since the graphite expands less than either the iron or the copper, the two materials are forced together during a furnace firing, thereby producing a diffusion bond or braze depending on the materials used to coat the copper and/or the iron. Other connection techniques could also be used for providing a flux sleeve.

FIG. 2 further illustrates how the flux sleeve 402 is connected to the rotor cover 404. In particular, a shoulder region 424 is defined about the outer periphery of the rotor cover 404. This shoulder 424 is adapted to receive the end of the magnetic sleeve portion 420 of the flux sleeve 402. Preferably, the magnetic sleeve is then affixed to the cover 404 with a braze joint, and is done so such that the joint occurs before (with respect to the rotating anode 102) the joint between the bearing shaft 202 and the bearing hub 300 (described above).

Also affixed to the rotor cover 404 is the rotor stem 406. Connected to the opposite end of the rotor stem 406 is the anode disk 102. While any one of a number of connection techniques can be used between the stem 406 and the anode disk 102, in the illustrated embodiment there is formed on the stem 406 an interface flange 410, that forms an anode connection interface 414. The anode disk 102 includes a bore 412 that is capable of receiving the stem 406, and which allows the anode 102 to abut against the connection interface 414 formed by the flange 410. The anode 102 is then affixed to the rotor stem 406 in the region of the connection interface 414 using a suitable connection technique, such as brazing. Other connection techniques could be used. For example, a braze washer could be sandwiched between the anode disk 102 and the rotor stem 406 and then electron beam brazed; the anode could be intertially welded to the rotor stem and then machined to size; the target anode and stem could both be threaded and then mechanically joined and brazed; or the anode could be mechanically joined to the stem by sandwiching the anode between a nut and a step formed in the rotor stem.

In some applications, the point of attachment between the anode target and the rotor stem 406 can reach a maximum operating temperature of up to 1100° C. Thus, if the stem 406 is constructed of a material having a CTE that is different from that of the anode target, the stresses that would be induced by the disparate expansion rates could result in a mechanical failure in the target and/or the stem, or could result in mechanical instabilities that negatively affect the quality of the x-ray image. Consequently, in a preferred embodiment, the material used to construct the rotor stem 406 is chosen such that its coefficient of thermal expansion substantially matches that of the anode target 102. In one preferred embodiment, the rotor stem 406 is constructed of the same refractory metal material that is used for the anode target 102. For example, if the target anode is constructed of a molybdenum alloy, such as TZM (titanium-zirconium-molybdenum), then that material would be used to construct the rotor stem 406 (including the rotor cover 404). In this example, the coefficient of thermal expansion for TZM is approximately $5.0–6.0\times10^{-6}$ in/in ° C.

Moreover, even though there is a considerable difference in the coefficient of thermal expansion between the rotor stem 406 and the preferred bearing shaft 202 material (approximately $12.0\times10^{-6}$ in/in ° C.), the bearing hub (having a CTE of approximately $8.0–10.0\times10^{-6}$ in/in ° C. in the preferred embodiments described above) provides an acceptable transition in thermal expansion rates so as to minimize any problems associated with thermal expansion of the materials. Further, because the intermediate expansion component (i.e., the bearing hub) is a component within the bearing assembly and is joined to the bearing shaft, the normal operating temperatures in the joint between the shaft and the hub is lower, and thus any thermal mismatch between those components is less problematic. Consequently, the design eliminates thermal mismatch in high heat areas, i.e., between the anode and the rotor stem 406, and at the same time minimizes the effect of thermal mismatches by gradually increasing the CTE between the anode and the relatively cooler bearing shaft 202.

To summarize, the present invention provides an anode drive assembly having numerous advantages over the prior art. In particular, by utilizing materials and components that provide a transition in the coefficients of thermal expansion between the anode and the bearing shaft, the assembly provides a number of highly desirable operating characteristics. Namely, the assembly minimizes the presence of severe thermal mismatches between adjacent components, thereby reducing the occurrence of disparate rates of thermal expansion between components. This minimizes the occurrence of mechanical instabilities within the drive assembly—even in the presence of severe operating temperatures. As such, the rotation of the anode is stable and precise, resulting in consistent positioning of the focal spot on the anode target. This in turn provides and x-ray tube that provides high quality x-ray images.

The present invention may be embodied in other specific forms without departing from its spirit or essential characteristics. The described embodiments are to be considered in all respects only as illustrative and not restrictive. For example, while specific materials have been specified in connection with preferred embodiments, it will be appreciated that other materials with similar coefficients of thermal expansions that otherwise meet the mechanical strength attributes dictated by a tube design can be used. Also, while one preferred operating environment is a CT scanner x-ray tube, the teachings of the present invention would find equal applicability and usefulness in connection with other x-ray tube and x-ray equipment types. The scope of the invention is, therefore, indicated by the appended claims rather than by the foregoing description. All changes which come within the meaning and range of equivalency of the claims are to be embraced within their scope.

What is claimed and desired to be secured by united states letters patent is:

1. An anode drive assembly for use in connection with an x-ray tube having a rotating anode target, the anode drive assembly comprising:

a target rotor connected to the anode target via a shaft portion that is comprised of a material having a first predetermined coefficient of thermal expansion;

a bearing shaft rotationally supported by a bearing surface, the bearing shaft being comprised of a material having a second predetermined coefficient of thermal expansion; and a bearing hub that interconnects the bearing shaft with the target rotor, wherein the bearing hub is comprised of a material having a coefficient of thermal expansion that is intermediate to the first and the second predetermined coefficient of thermal expansion, the bearing hub further comprising:

a radially extending flange portion including at least one raised portion extending from the flange portion, wherein the target rotor and the bearing hub directly contact one another at the at least one raised portion.

2. An anode drive assembly as defined in claim 1, wherein the first predetermined coefficient of thermal expansion (CTE) is substantially equal to the CTE of the anode target material.

3. An anode drive assembly as defined in claim 2, wherein the anode target is comprised of a molybdenum alloy.

4. An anode drive assembly as defined in claim 1, wherein the at least one raised portion comprises a ridge disposed about a periphery of the flange portion.

5. An anode drive assembly as defined in claim 1, wherein the bearing hub is comprised of a super alloy.

6. An anode drive assembly as defined in claim 5, wherein the super alloy has a coefficient of thermal expansion between approximately $8.0\times10^{-6}$ in/in ° C. and $10.0\times10^{-6}$ in/in ° C.

7. An anode drive assembly as defined in claim 1, wherein the bearing shaft is comprised of a material having a coefficient of thermal expansion between approximately $10.0\times10^{-6}$ in/in ° C. and $15.0\times10^{-6}$ in/in ° C.

8. An anode drive assembly as defined in claim 1, wherein the target rotor includes a sleeve that provides the rotor portion of an induction motor, the sleeve being affixed to the shaft portion of the rotor.

9. An anode drive assembly as defined in claim 1, wherein the shaft portion of the rotor is connected to the bearing hub with at least one fastener, the at least one fastener being comprised of a material having a coefficient of thermal expansion that is substantially equal to the coefficient of thermal expansion of the bearing hub.

10. An anode drive assembly as defined in claim 1, wherein the shaft portion of the rotor is connected to the bearing hub with at least one fastener, the at least one fastener being comprised of a material having a coefficient of thermal expansion that is substantially equal to the first predetermined coefficient of thermal expansion.

11. The anode drive assembly as recited in claim 1, wherein the first predetermined coefficient of thermal expansion is greater than the intermediate coefficient of thermal expansion.

12. The anode drive assembly as recited in claim 1, wherein the first predetermined coefficient of thermal expansion is less than the intermediate coefficient of thermal expansion.

13. The anode drive assembly as recited in claim 1, wherein the bearing hub is at least partially hollow.

14. The anode drive assembly as recited in claim 1, wherein at least the shaft portion of the target rotor substantially comprises a refractory metal.

15. An anode drive assembly for providing rotational support to an anode target within an x-ray tube, the anode drive assembly comprising:.

(a) a target rotor assembly comprising:

a cylindrical sleeve that provides the rotor portion of an induction motor that is capable of inducing rotational motion to the sleeve; and a rotor shaft assembly having a first end connected to the sleeve so that rotation of the sleeve induces a corresponding rotation in the shaft, and a second end connected to the anode target and wherein the rotor shaft is comprised of a material having a first predetermined coefficient of thermal expansion that is substantially equal to that of a material used to construct the anode target;

(b) a bearing assembly comprising:

a bearing shaft rotationally supported by a bearing surface, the bearing shaft being comprised of a material having a second predetermined coefficient of thermal expansion that is greater than the first predetermined coefficient of thermal expansion; and a bearing hub that interconnects the bearing shaft with the target rotor assembly, wherein the bearing hub is comprised of a material having a coefficient of thermal expansion that is intermediate to the first and the second predetermined coefficient of thermal expansion, the bearing hub further comprising:

an annular flange portion, the flange portion including a raised portion that extends from a surface of the flange portion, wherein the target rotor assembly contacts the bearing hub only along the raised portion.

16. An anode drive assembly as defined in claim 15, wherein the raised portion comprises a ridge disposed about an outer periphery of the flange portion.

17. The anode drive assembly as recited in claim 15, wherein the first predetermined coefficient of thermal expansion is greater than the intermediate coefficient of thermal expansion.

18. The anode drive assembly as recited in claim 15, wherein the first predetermined coefficient of thermal expansion is less than the intermediate coefficient of thermal expansion.

19. An x-ray tube, comprising:

(a) an evacuated envelope;

(b) an electron source and an anode disposed in a spaced apart configuration within the evacuated envelope so that the anode is arranged to receive electrons emitted by the electron source; and (c) an anode drive assembly operably connected to the anode and comprising:

(i) a target rotor assembly including a rotor stem upon which the anode is mounted, the rotor stem substantially comprising a material having a first coefficient of thermal expansion;

(ii) a bearing assembly including a bearing shaft substantially comprised of a material having a second coefficient of thermal expansion; and (iii) a bearing hub that interconnects the bearing shaft and the target rotor assembly, the bearing hub substantially comprising a material having a coefficient of thermal expansion with a value between the first and second coefficients of thermal expansion, the bearing hub further comprising:

a radially extending flange portion having at least one raised structure orthogonally extending from a surface of the flange portion, wherein the raised structure substantially limits direct contact between the bearing hub and the target rotor assembly to the at least one raised structure.

20. The x-ray tube as recited in claim 19, wherein the anode has a coefficient of thermal expansion that is substantially the same as the first coefficient of thermal expansion.

21. The x-ray tube as recited in claim 19, wherein the rotor stem substantially comprises a refractory metal.

22. The x-ray tube as recited in claim 19, wherein the rotor stem and the anode comprise substantially the same material.

23. The x-ray tube as recited in claim 22, wherein the material of the rotor stem and the anode comprises a titanium-zirconium-molybdenum alloy.

24. The x-ray tube as recited in claim 19, wherein the bearing shaft is welded to the bearing hub.

25. The x-ray tube as recited in claim 19, wherein the bearing hub is attached to the rotor assembly with one or more fasteners.

26. The x-ray tube as recited in claim 25, wherein the one or more fasteners substantially comprise a material having a coefficient of thermal expansion that is substantially the same as the coefficient of thermal expansion of the bearing hub.

27. The x-ray tube as recited in claim 25, wherein the one or more fasteners substantially comprise a material having a coefficient of thermal expansion that is substantially the same as the first coefficient of thermal expansion.

28. The x-ray tube as recited in claim 19, wherein the bearing hub substantially comprises a super alloy.

29. The x-ray tube as recited in claim 19, wherein the bearing hub is bolted to the target rotor assembly and welded to the bearing shaft.

30. The anode drive assembly as recited in claim 19, wherein the first predetermined coefficient of thermal expansion is less than the intermediate coefficient of thermal expansion.

31. The x-ray tube as recited in claim 19, wherein the target rotor assembly further comprises a rotor cover to which the rotor stem is welded.

32. The x-ray tube as recited in claim 31, wherein the bearing hub is attached to the rotor cover with one or more fasteners.

33. The anode drive assembly as recited in claim 19, wherein the bearing hub is at least partially hollow.

34. The anode drive assembly as recited in claim 19, wherein the first predetermined coefficient of thermal expansion is greater than the intermediate coefficient of thermal expansion.

35. An anode drive assembly suitable for use in conjunction with an anode of an x-ray device, the anode drive assembly comprising:

(a) a target rotor assembly including a rotor stem adapted to mate with the anode, the rotor stem substantially comprising a material having a first coefficient of thermal expansion;

(b) a bearing assembly including a bearing shaft substantially comprised of a material having a second coefficient of thermal expansion; and (c) means for interconnecting the bearing shaft and the target rotor assembly, the means for interconnecting serving to implement an intermediate coefficient of thermal expansion within the anode drive assembly, the intermediate coefficient of thermal expansion having a value between the first and second coefficients of thermal expansion, the means for interconnecting further comprising means for resisting the transfer of heat from the target rotor assembly to the bearing shaft.

36. The anode drive assembly as recited in claim 35, wherein the means for interconnecting comprises a bearing hub interconnecting the bearing shaft and the target rotor assembly, and wherein the means for resisting comprises a ridge defined on the bearing hub such that direct contact between the bearing hub and the target rotor assembly is limited to the ridge.

37. The anode drive assembly as recited in claim 35, wherein the first predetermined coefficient of thermal expansion is greater than the intermediate coefficient of thermal expansion.

38. The anode drive assembly as recited in claim 35, wherein the first predetermined coefficient of thermal expansion is less than the intermediate coefficient of thermal expansion.

39. The anode drive assembly as recited in claim 35, wherein the means for interconnecting comprises a bearing hub interconnecting the bearing shaft and the target rotor assembly.

40. The anode drive assembly as recited in claim 39, wherein the bearing hub substantially comprises a super alloy.

41. An x-ray tube, comprising:

(a) an evacuated envelope;

(b) an electron source and an anode disposed in a spaced apart configuration within the evacuated envelope so that the anode is arranged to receive electrons emitted by the electron source; and (c) an anode drive assembly operably connected to the anode and comprising:

(i) a target rotor assembly including a rotor stem upon which the anode is mounted, the rotor stem substantially comprising a material having a first coefficient of thermal expansion;

(ii) a bearing assembly including a bearing shaft substantially comprised of a material having a second coefficient of thermal expansion; and (iii) a bearing hub that interconnects the bearing shaft and the target rotor assembly, the bearing hub substantially comprising a material having a coefficient of thermal expansion with a value between the first and second coefficients of thermal expansion, the bearing hub further comprising:

a radially extending flange portion having at least one ridge orthogonally extending from a surface of the flange portion, wherein the at least one ridge substantially limits direct contact between the bearing hub and the target rotor assembly to the at least one ridge.

42. An x-ray tube as defined in claim 41, wherein the at least one ridge orthogonally extends from a peripheral surface of the flange portion.

* * * * *